US006035849A

United States Patent [19]

Bluestone

[11] Patent Number: 6,035,849

[45] Date of Patent: Mar. 14, 2000

[54] DAMPER CLIP EXTENSION

[75] Inventor: Richard A. Bluestone, Mayfield Heights, Ohio

[73] Assignee: Alan Manufacturing, Inc., Cleveland, Ohio

[21] Appl. No.: 09/294,291

[22] Filed: Apr. 19, 1999

[51] Int. Cl.[7] ..... F23L 3/00

[52] U.S. Cl. ..... 126/285 R; 251/308

[58] Field of Search ..... 251/308; 126/285 R, 126/289

[56] References Cited

U.S. PATENT DOCUMENTS

| | | |
|---|---|---|
| 2,106,093 | 1/1938 | Goese . |
| 2,130,476 | 9/1938 | Young . |
| 2,183,292 | 12/1939 | Kerentoff . |
| 2,230,882 | 2/1941 | Cameron . |
| 2,323,038 | 6/1943 | Heasley et al. . |
| 2,362,623 | 11/1944 | Fossum . |
| 2,488,006 | 11/1949 | De Roo . |
| 2,966,169 | 12/1960 | Reece . |
| 3,722,499 | 3/1973 | Lukjan . |
| 4,500,224 | 2/1985 | Ewing . |
| 4,646,715 | 3/1987 | Russell . |

*Primary Examiner*—Carroll Dority

*Attorney, Agent, or Firm*—D. Peter Hochberg; William H. Holt

[57] ABSTRACT

An extension assembly for use with a damper assembly and for extending the damper assembly control shaft. The extension assembly is provided for coupling of a handle to the control shaft and includes an extension member, a locking member and a securing member. The extension member includes a connecting portion having a closed end and an open end. The open end includes a bore dimensioned to operatively receive the control shaft. The extension member further includes a shaft portion extending longitudinally from the closed end of the connecting portion. The shaft portion includes two parallel flat sides merging transversely with two opposite arcuate sides and dimensioned to be received by an aperture in the handle. The locking member provides the function of locking the control shaft within bore. The securing member ensures that the handle will remain a fixed distance from duct and provides a lock tight surface for a nut to engage and hold the handle.

10 Claims, 2 Drawing Sheets

DAMPER CLIP EXTENSION

BACKGROUND OF THE INVENTION

1. Field of the Invention

The present invention relates generally to ductwork and more particularly to a damper clip extension for extending a damper assembly control shaft.

2. Description of Prior Art

Ductwork in buildings is usually provided with damper assemblies for manually controlling air flow through the ductwork. In many cases the damper is connected to a control shaft that extends through the duct work to a handle. The handle can be turned to rotate the damper to block the flow of air through the duct. The control shaft extends from the duct a very short distance. In many cases the duct can be wrapped with materials such as insulation. This blocks the access to the handle or makes it difficult to turn the handle. The solution to this problem has been to provide damper clip extensions connected by one end to the control shaft, and by the other end to a handle. The problem with the prior art extensions are that these extensions have been difficult or impossible to manufacture and expensive to machine.

For example, U.S. Pat. No. 4,646,715 discloses a damper clip extension having a control shaft with a threaded end having a first transverse configuration of two oppositely facing arcuate sides merging with two oppositely facing flat sides. An extension is provided that includes a closed end and an open end, wherein the open end includes a bore for receiving the threaded end of the control shaft. The open end further includes two open sides, so that the control shaft is exposed once received by the open end of the extension. The closed end of the extension has a similar transverse configuration as the control shaft threaded end. The problem with this design is that the threads in the open end of the extension are difficult and impractical to machine. This results in a device that cannot be made, or cannot be made at a practical price.

Additionally, there is no means provided for preventing the extension from becoming loosened from the control shaft over an extended time period.

SUMMARY OF THE INVENTION

In accordance with a preferred embodiment of the present invention, an extension assembly is provided for use with a damper assembly. The damper assembly includes a portion of a duct, a damper within the duct, and a damper clip having an attaching portion attached to the damper and a control shaft extending through an aperture in the duct. The control shaft includes two parallel flat sides merging transversely with two opposite arcuate sides. The damper assembly further includes a handle, and means for cooperating with a means for securing the handle. The damper is rotatable about an axis to enable the damper to selective by control fluid flow through the duct upon rotation of the control shaft. The handle includes an aperture dimensioned to receive the control shaft. The extension assembly provides apparatus for the coupling of the handle to the control shaft, and includes an extension member having a connecting portion with a closed end and an open end. The open end of the connecting portion includes a bore dimensioned to receive and surround the control shaft. The extension member further includes a shaft portion extending longitudinally from the closed end of the connecting portion, and having two parallel flat sides merging transversely with two opposite arcuate sides, and dimensioned to be received by the aperture of the handle. The extension assembly further includes locking means for securing the control shaft inside the bore, and securing means for cooperating with the means for securing the handle to the control shaft to fix the distance of the handle from the duct, and provide fixed attachment of the handle to the shaft portion.

In another preferred aspect of the invention, there is provided an extension assembly for use with a damper assembly. The damper assembly includes a portion of a duct, a damper within the duct, and a damper clip having an attaching portion attached to the damper and a control shaft extending through an aperture in the duct. The control shaft includes two parallel flat sides merging transversely with two opposite arcuate sides, the arcuate sides being threaded. The damper assembly further includes a handle, and means for securing the handle to the control shaft. The damper is rotatable about an axis to enable the damper to selective by control fluid flow through the duct upon rotation of the control shaft. The handle includes an aperture dimensioned to receive the control shaft. The extension assembly provides apparatus for the coupling of the handle to the control shaft, and includes an extension member having a cylindrical portion with a closed end and an open end. The open end includes a threaded bore dimensioned to receive the control shaft and to threadingly engage the arcuate sides of the control shaft. The extension further includes a shaft portion extending longitudinally from the closed end of the cylindrical portion, and having two parallel flat sides merging transversely with two opposite arcuate sides and dimensioned to be received by the aperture of the handle. Additionally, the extension assembly includes securing means for cooperating with the means for securing the handle to the control shaft to fix the distance of the handle from the duct, and provide apparatus for the coupling and fixed attachment of the handle to the shaft portion.

An object of this invention is to provide an apparatus to extend a control shaft of a damper assembly.

A further object of this invention is to provide an apparatus to extend a control shaft of a damper assembly that is easy and inexpensive to manufacture.

Another object of this invention is to provide an apparatus to extend a control shaft of a damper assembly that does not require precise machining.

Another object of this invention is to provide an apparatus to extend a control shaft of a damper assembly that include means for preventing the apparatus from becoming disengaged or loosened from the control shaft over a period of time.

Yet another object of this invention is to provide an apparatus to extend a control shaft of a damper assembly that is simple to assembly and easy to use.

These and other object will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
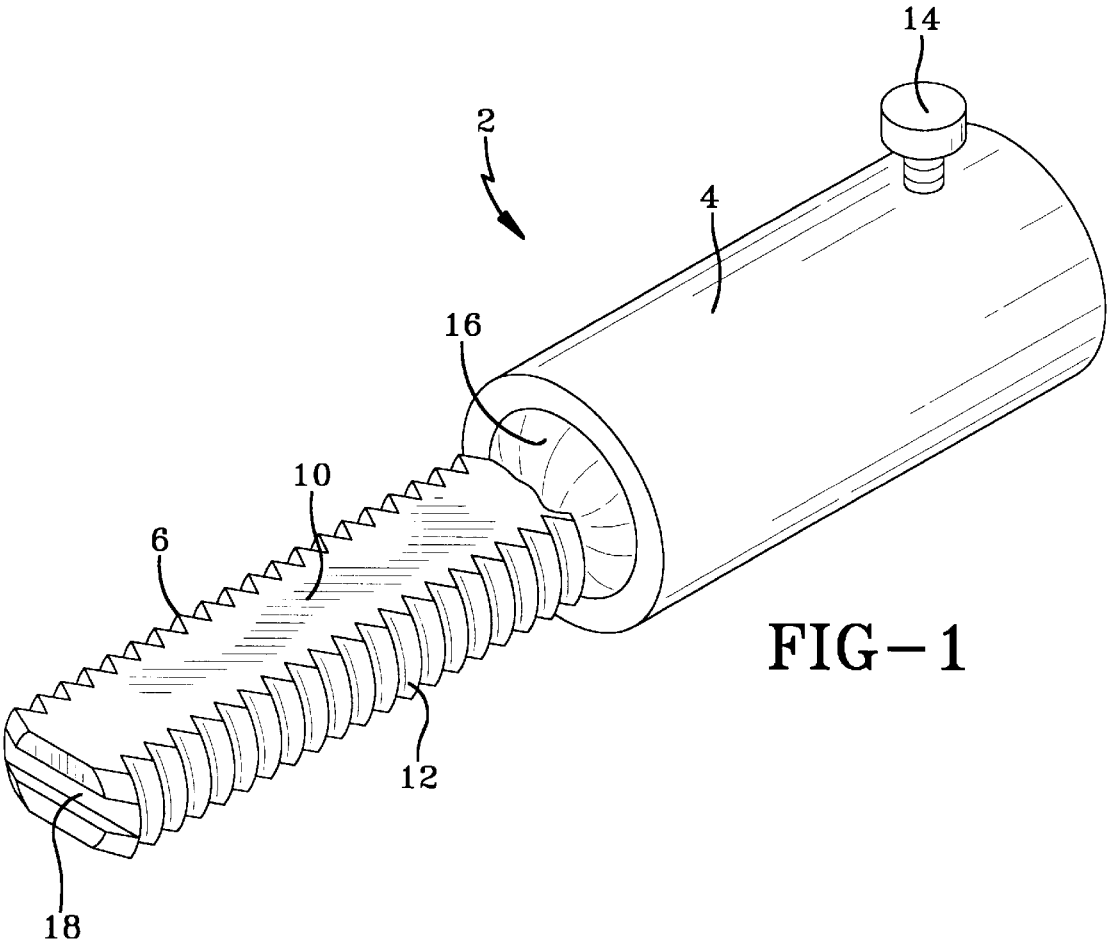
FIG. 1 is a side perspective view of the preferred extension member.
Figure 2:
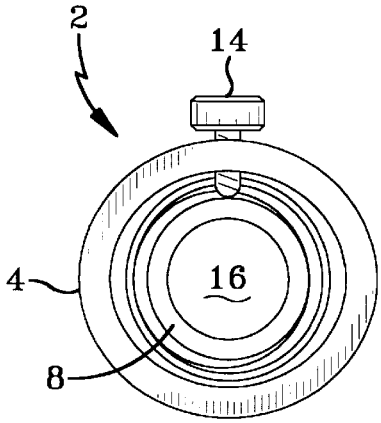
FIG. 2 is a rear view of the preferred extension member of FIG. 1.

Referring now to the drawings wherein the showings are for the purpose of illustrating the preferred embodiment of the invention only, and not for the purpose of limiting same, FIG. 1 and FIG. 2 show an extension member 2 having a cylindrical connecting portion 4 and a shaft portion 6. Cylindrical portion 4 and shaft portion 6 each have a closed end and an open end. Each of the closed ends are connected to a solid sloping portion 16, such that the extension member is integral. Shaft portion 6 is shaped similarly to a conventional damper clip control shaft, and includes two flat sides 10 that are parallel to one another and two arcuate sides 12 opposite to one another. The two parallel flat sides 10 merge transversely with the two opposite arcuate sides 12. Arcuate sides 12 are threaded to cooperate with a conventional wing nut. Flat sides 10 provide keying for a conventional damper handle. A notch 18 is provided on the open end of shaft portion 6 for receiving a conventional flat head screw driver. It should be appreciated that a second slot perpendicular to the first slot could be machined into the open end of shaft portion 6 for receiving both a flat head or a Phillips head screw driver.

Cylindrical portion 4 extends longitudinally outward from shaft portion 6. A threaded bore 8 extends longitudinally inward from the open end of cylindrical portion 4, until it meets with sloping portion 16. Bore 8 is threaded to mate with the control shaft of a typical damper clip. A locking member 14 is provided to lock the control shaft in a fixed position after the control shaft is threaded into threaded bore 8. The use of locking member 14 provides a way to ensure the appropriate extended length of the control shaft is disposed in the bore, while also keeping the control shaft from becoming dislodged from threaded bore 8.

It should be appreciated that locking member 14 allows for much less precise machining in the threads, than in the prior art, because the threads are needed only for guiding, and not for locking, the control shaft within the bore. Thus, locking member 14 provides the function of locking the control shaft within bore 8, so that the control shaft remains fixed and does not rotate, rattle or become dislodged. This function is not limited to use of a single conventional screw but could be provided in many different forms. For example, an outer threaded insert could be provided for being inserted into the bore to limit the length of travel of the control shaft, while providing a lock-tight engagement surface for the end of the control shaft. Additionally, a plurality of screws or fasteners could be used to lock in the control shaft. In this case, it is not necessary to provide a threaded bore, as long as the bore completely surrounds the control shaft. The connecting portion does not have to be cylindrical but could be elliptical or have a variety of configurations. The bore could be shaped with two long sides and two arcuate sides, similarly to the shaft portion. This would provide for a configuration that only needs a single locking member to fix the control shaft in the bore because the sides will prevent the control shaft from rotating.

Figure 3:
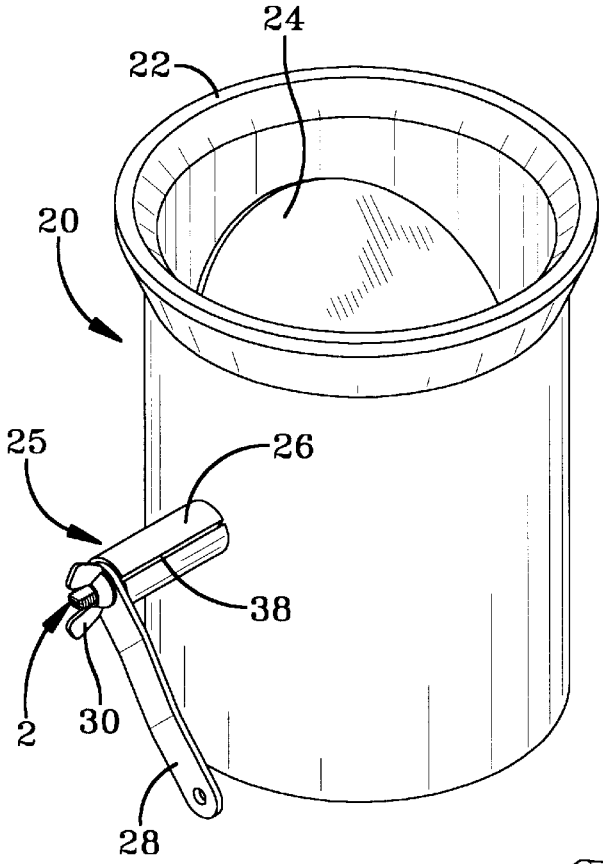
FIG. 3 is a front perspective view of a damper assembly on which the extension assembly of the present invention in accordance with a preferred embodiment is installed.
Figure 5:
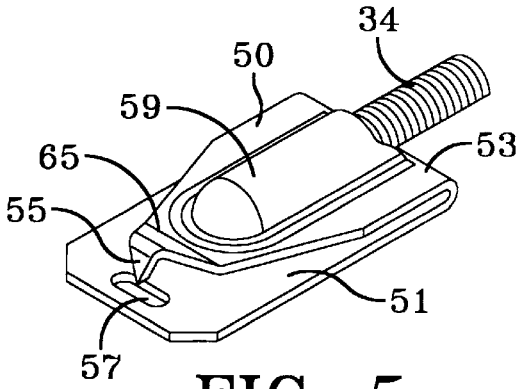
FIG. 5 is a perspective view from the left side of the damper clip shown in FIG. 4.
Figure 4:
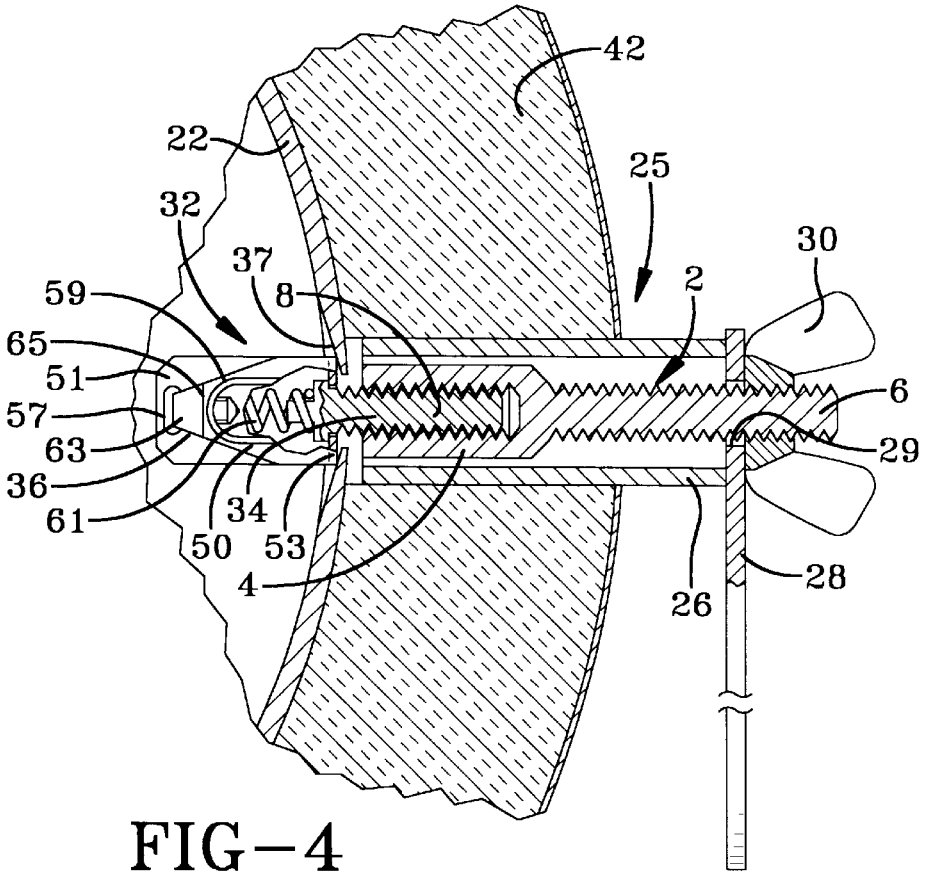
FIG. 4 is a longitudinal cross sectional view of the extension assembly as installed onto a damper controlled shaft.

FIG. 3 and FIG. 4 illustrate extension member 2 in accordance with a preferred embodiment of the invention installed in a damper assembly 20. Damper assembly 20 includes a duct 22, a damper 24 and an extension assembly 25 connected to a damper clip 32. Damper clip 32 is a conventional damper clip and includes an attachment member portion 36 and a control shaft portion 34. Damper clip 32 advantageously comprises overlapping walls 50, 51, and can be an integral piece folded over at bent portion 53. Wall 50 has a triangularly pointed free end 55 (shown in FIG. 5) directed towards a receiving hole 57 in wall 51. Free end 55 engages damper 24. A raised semi-cylindrical portion 59 of wall 50 cooperates with a portion of wall 51 to provide a compartment for control shaft portion 34 to slide in against a spring 61 (part of portion 59 is omitted to show the control shaft and the spring). An upwardly inclined portion 63 of wall 50 is bent at fold line 65 so that free end 55 can be bent towards wall 51.

Attachment member 36 attaches to damper 24 inside duct 22. Control shaft portion 34 extends longitudinally away from attachment member portion 36 through an aperture 37 in duct 22. Control shaft portion 34 has the same shape as shaft portion 6 of extension member 2 previously described. Extension assembly 25 includes extension member 2 and a securing member 26. Securing member 26 is a hollow cylindrical member having a cavity formed therein. It is dimensioned to surround extension member 2, and provide any necessary clearance for use of locking members that may extend in a radial direction. A slit 38 along the entire longitudinal axis may be provided to allow for expansion of securing member 26 due to variations in locking member 14 and in control shaft sizes. Securing member 26 has a length shorter than the length of extension member 2, so that shaft portion 6 extends beyond the end of securing member 26.

If an insulating layer is not provided, a handle 28 having an aperture 29, dimensioned to receive either control shaft portion 34 (if no extension assembly 25 is required) or shaft portion 6, can be placed over control shaft portion 34, and locked into place by a wing nut. Aperture 29 has a longitudinal axis that is coaxial to the control shaft longitudinal axis, when control shaft 34 is inserted into aperture 29. Additionally, aperture 29 has two oppositely facing arcuate sides merging with two oppositely facing flat sides, such that the shape of the aperture corresponds with the shape of the control shaft. This allows the handle to be nonrotatably coupled to the control shaft, so that whenever the handle is rotated, the control shaft is also rotated. However, when a layer of insulation is provided such as layer 42 shown in FIG. 4, then the current invention provides for an extension assembly 25 as has been previously described.

Installation of the current invention is easily facilitated by cutting out a portion of the insulation around aperture 37 in the damper assembly for extending control shaft 34. After attaching attachment member portion 36 to damper 24, and extending control shaft 34 through the aperture in the duct, extension assembly 25 can be assembled. The open end of cylindrical portion 4 is placed in alignment with control shaft 34, so that the longitudinal axis of the control shaft 34 is coaxial with the longitudinal axis of threaded bore 8. Extension member 2 can then be rotated clockwise for threadingly engaging control shaft 34 in threaded bore 8. Extension member 2 can be rotated by hand by turning shaft portion 6, or by using a flat head screw driver engaged in notch 18. Once the appropriate extended length has been determined, locking member 14 can be engaged (as shown in FIG. 1 and 2) to hold control shaft 34 at the determined length, and to deter disengagement of control shaft 34 in threaded bore 8.

Securing member 26 is then placed over extension member 2, such that the open end of shaft portion 6 of extension member 2 extends outside of securing member 26. Preferably, a washer (not shown) is placed over open end of shaft portion 6, and then the aperture 29 of handle 28 is slid over shaft portion 6. Handle 28 is then secured into place by wing nut 30. Handle 28 can then be rotated clockwise or counterclockwise to rotate damper 24 in duct 22, thus controlling the air flow through damper 24.

Securing member 26 provides a variety of functions. First, securing member 26 ensures that the handle will remain a fixed distance from duct 22, by limiting the length of travel of handle 28 and wing nut 30. Additionally, securing member 26 provides fixed attachment of handle 28 to shaft portion 6 by providing a lock tight surface for wing nut 30 to engage. It should be appreciated that these functions could be accomplished by using other means in place of securing member 26. Any surface that limits the length of travel and provides a lock tight surface can be employed. For example, a conventional nut may be threaded onto shaft portion 6, then handle 28 placed onto shaft portion 6, and then the handle can be locked into place by simultaneously tightening the nut and the wing nut against the handle. Further, a conventional washer can be fixed a specified distance on shaft portion 6 by soldering or welding, and handle 28 placed over shaft portion 6 and locked in place by wing nut 40.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. An extension assembly for use with a damper assembly, the damper assembly including a portion of a duct, a damper within the duct, and a damper clip having an attaching portion attached to the damper and a control shaft extending through an aperture in the duct, the control shaft having two parallel flat sides merging transversely with two opposite arcuate sides, a handle, and means for securing the handle to the control shaft, the control shaft having means for cooperating with the means for securing the handle to the control shaft, the damper being rotatable about an axis to enable the damper to selective control fluid flow through the duct upon rotation of the control shaft, the handle having an aperture dimensioned to receive the control shaft, said extension assembly providing coupling of the handle to the control shaft and comprising:

an extension member including:

a connecting portion having a closed end and an open end, said open end having a bore dimensioned to operatively receive the control shaft;

a shaft portion extending longitudinally from the closed end of said connecting portion, said shaft portion having two parallel flat sides merging transversely with two opposite arcuate sides and dimensioned to be received by the aperture of the handle;

locking means for securing the control shaft inside said bore; and securing means for cooperating with the means for securing the handle to the control shaft to fix the distance of the handle from the duct and provide fixed attachment of the handle to said shaft portion.

2. The extension assembly of claim 1, wherein said connecting portion is cylindrical and said bore is a cylindrical threaded bore, and said threaded bore cooperates with the means of the control shaft for cooperating with the means for securing the handle on the shaft portion for selectively rotating the control shaft.

3. The extension member of claim 1, wherein said locking means is a single conventional screw threadingly engaged in an aperture in said connecting portion, said aperture extending through to said bore, wherein rotation of said screw in one direction causes contact of the screw with the control shaft and locking of the control shaft in a fixed position within said bore.

4. The extension member of claim 1, wherein said securing means is a hollow cylindrical securing member having a cavity formed therein, said cavity being dimensioned to be placed over said extension member, said securing member having a length that is shorter than the length said extension member, the handle being securable onto said shaft portion where said shaft portion emerges from said securing member cavity.

5. The extension member of claim 1 wherein said shaft portion has a closed end at the closed end of said connecting portion and an open end is, and further including a notch disposed in said open end of said shaft portion, said notch being transverse to the longitudinal axis of said shaft portion and being dimensioned to receive a conventional screwdriver.

6. An extension assembly for use with a damper assembly, the damper assembly including a portion of a duct, a damper within the duct, and a damper clip having an attaching portion attached to the damper and a control shaft extending through an aperture in the duct, the control shaft having two parallel flat sides merging transversely with two opposite arcuate sides, the arcuate sides being threaded, a handle, and means for securing the handle to the control shaft, the damper being rotatable about an axis to enable the damper to selective control fluid flow through the duct upon rotation of the control shaft, the handle having an aperture dimensioned to receive the control shaft, said extension assembly providing coupling of the handle to the control shaft, said extension assembly comprising:

an extension member including:

a cylindrical portion having a closed end and an open end, said open end having a threaded bore dimensioned to receive the control shaft and to threadingly engage the arcuate sides of the control shaft;

a shaft portion extending longitudinally from the closed end of said cylindrical portion, said shaft portion having two parallel flat sides merging transversely with two opposite arcuate sides and dimensioned to be received by the aperture of the handle; and securing means for cooperating with the means for securing the handle to the control shaft to fix the distance of the handle from the duct and provide for the coupling and fixed attachment of the handle to said shaft portion.

7. The extension member of claim 6, and further including locking means for securing the control shaft inside said bore.

8. The extension member of claim 7, wherein said locking means is a single conventional screw threadingly engaged in an aperture in said cylindrical portion, said aperture extending through to said bore, wherein rotation of said screw in one direction causes contact of the screw with the control shaft and locking of the control shaft in a fixed position within said bore.

9. The extension member of claim 6, wherein said securing means is a hollow cylindrical securing member having a cavity formed therein, said cavity being dimensioned to be placed over said extension member, said securing member having a length that is shorter than the length said extension member such that the handle may be secured onto said shaft portion where said shaft portion emerges from said securing member cavity.

10. The extension member of claim 6 wherein said shaft portion has a closed end at the closed end of said connecting portion and an open end, and further including a notch disposed in said open end of said shaft portion, said notch being transverse to the longitudinal axis of said shaft portion and being dimensioned to receive a conventional screwdriver.

* * * * *